US007681696B2

(12) United States Patent
Yamagishi

(10) Patent No.: US 7,681,696 B2
(45) Date of Patent: Mar. 23, 2010

(54) EARTHQUAKE CONTROL SYSTEM FOR ELEVATOR AND ELEVATOR SYSTEM USING PREDICTED ARRIVAL HOUR

(75) Inventor: Koji Yamagishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 875 days.

(21) Appl. No.: 11/429,279

(22) Filed: May 8, 2006

(65) Prior Publication Data

US 2007/0131486 A1 Jun. 14, 2007

(30) Foreign Application Priority Data

Dec. 12, 2005 (JP) ..... 2005-357423

(51) Int. Cl.
*B66B 1/20* (2006.01)

(52) U.S. Cl. ..... 187/384; 187/388; 187/313

(58) Field of Classification Search ..... 187/391–394, 187/278, 247, 313
See application file for complete search history.

(56) References Cited

U.S. PATENT DOCUMENTS

| | | | | |
|---|---|---|---|---|
| 4,382,489 | A * | 5/1983 | Suzuki et al. | 187/278 |
| 4,809,817 | A * | 3/1989 | Kawai | 187/278 |
| 4,998,601 | A * | 3/1991 | Suzuki | 187/278 |
| 5,407,028 | A * | 4/1995 | Jamieson et al. | 187/288 |
| 5,910,763 | A * | 6/1999 | Flanagan | 340/286.02 |
| 6,321,877 | B2 * | 11/2001 | Yamakawa | 187/391 |
| 7,182,174 | B2 * | 2/2007 | Parrini et al. | 182/18 |
| 2009/0133963 | A1 * | 5/2009 | Amano | 187/247 |

FOREIGN PATENT DOCUMENTS

| | | | |
|---|---|---|---|
| JP | 2000242878 | A * | 9/2000 |
| JP | 2004-224469 | | 8/2004 |
| JP | 2004224469 | A * | 8/2004 |
| JP | 2004-284758 | | 10/2004 |
| JP | 2007119218 | A * | 5/2007 |
| JP | 2007119240 | A * | 5/2007 |
| JP | 2008037566 | A * | 2/2008 |
| JP | 2008100797 | A * | 5/2008 |
| JP | 2008114961 | A * | 5/2008 |
| JP | 2009001368 | A * | 1/2009 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

The earthquake control operation system for an elevator includes: an earthquake information delivering device for calculating a predicted arrival hour of earthquake waves in accordance with a position of a registered building based on an emergency earthquake bulletin including at least a seismic center of an earthquake and an hour of occurrence of the earthquake; an earthquake information receiving device for receiving the predicted arrival hour through an Internet and calculating an earthquake arrival need time as a time required for the earthquake waves to reach the building based on the predicted arrival hour; and an elevator control panel for performing an operation of stopping an elevator car at a safety floor when the elevator car is traveling toward the safety floor, a car call for the safety floor is registered, and a stop time at the safety floor is shorter than the earthquake arrival need time.

6 Claims, 8 Drawing Sheets

EARTHQUAKE CONTROL SYSTEM FOR ELEVATOR AND ELEVATOR SYSTEM USING PREDICTED ARRIVAL HOUR

BACKGROUND OF THE INVENTION

1. Field of the Invention

The present invention relates to an earthquake control operation system for an elevator for allowing passengers in an elevator installed in a building to get off promptly in the event of an earthquake, and more particularly, to an earthquake control operation system for an elevator for ensuring the safety of passengers before an earthquake strikes the elevator and for minimizing the damage caused to its components.

2. Description of the Related Art

A conventional earthquake control operation system for an elevator is provided with a P-wave earthquake sensor for detecting a preliminary tremor of an earthquake or an S-wave earthquake sensor for detecting a principal motion of an earthquake, and performs a control operation. That is, the conventional earthquake control operation system stops the elevator at the nearest floor when the earthquake sensor is operated, or brings the elevator to a sudden halt when an earthquake of a high seismic intensity is detected by the S-wave earthquake sensor.

In one known earthquake control operation system for an elevator as described above, operation information of earthquake sensors is transferred from a building to a management station. A control command is delivered from the management station as for the elevator to perform a control operation. As a result, the number of earthquake sensors can be reduced, and an earthquake control operation can be performed reliably (e.g., see JP 2002-46953 A).

In another known earthquake control operation system for an elevator, the operating states of earthquake sensors installed in various spots of the country are delivered via the Internet and information on an earthquake is thereby acquired in advance instead of performing an earthquake control operation in response to the operation of an earthquake sensor installed in a building. As a result, passengers are allowed to get off a car of the elevator at a safety floor or the nearest floor before the arrival of earthquake waves (e.g., see JP 2004-284758 A and JP 2004-224469 A).

In the conventional earthquake control operation system for the elevator, the earthquake control operation is performed after the earthquake sensor has been operated, so the elevator must be moved even when the occurrence of an earthquake motion has caused a collision of components in a hoistway or strong vibrations of a rope. In many cases, therefore, the components in the hoistway and a rail are damaged.

In the earthquake control operation system in which information on an earthquake is delivered via the Internet, an operation of stopping the elevator at a safety floor is performed if the elevator can be stopped at the safety floor when the information on the earthquake has been received, so the elevator is caused to travel toward the safety floor through a change of direction even when it is traveling away from the safety floor. For this purpose, the car of the elevator needs to be stopped temporarily. Thus, there is a problem in that the car starts traveling again despite temporary stoppage thereof.

In addition, since an attempt to stop the car at the nearest floor is made regardless of whether the car can be stopped at the nearest floor or not, the operation of stopping the car at the nearest floor may not be completed in a situation requiring a long time to stop the car at the nearest floor as in the case of an express zone. As a result, the elevator may still be traveling when the earthquake waves have arrived. This situation causes a problem in that passengers are locked up in the elevator due to sudden stoppage thereof or a restoration is delayed as a result of a damage caused to the components in the hoistway.

SUMMARY OF THE INVENTION

The present invention has been made to solve the above-mentioned problems. It is therefore an object of the present invention to obtain an earthquake control operation system for an elevator which is capable of reliably stopping a car of the elevator prior to the occurrence of an earthquake and preventing components in a hoistway of the elevator from being damaged by coming into contact with or being hung up on the car as a result of a travel of the elevator during the occurrence of the earthquake.

An earthquake control operation system for an elevator according to the present invention is provided with an earthquake information delivering device for calculating a predicted arrival hour of earthquake waves in accordance with a position of a registered building based on an emergency earthquake bulletin including at least a seismic center of an earthquake, a depth of the seismic center, and an hour of occurrence of the earthquake; an earthquake information receiving device installed in the building, for receiving the predicted arrival hour through a communication network and calculating an earthquake arrival need time as a time required for the earthquake waves to reach the building based on the predicted arrival hour; and an elevator control panel for performing an operation of stopping an elevator car at a safety floor when the elevator car is traveling toward the safety floor, a car call for the safety floor is registered, and a stop time at the safety floor is shorter than the earthquake arrival need time.

The earthquake control operation system for the elevator according to the present invention can reliably stop the car before the occurrence of an earthquake, and therefore, achieves an effect of preventing components in a hoistway of the elevator from being damaged by coming into contact with or being hung up on the car as a result of a travel of the elevator during the occurrence of the earthquake.

A valid condition for stopping the car at the safety floor is defined as a state where there is a car call for the safety floor while the elevator is traveling toward the safety floor, and the operation of determining whether or not the car can be stopped at the safety floor is provided. Thus, the car is stopped at the safety floor when passengers intend to go to the safety floor and there is no dead time created as in the case of inversion of the car traveling direction, so a control operation reflecting the intention of the passengers is performed. As a result, the earthquake control operation system for the elevator according to the present invention achieves an effect capable of alleviating the passengers' anxiety that they may stay inside the car for a long time.

Moreover, it is determined whether or not the car can be stopped at the nearest floor from a temporal point of view, and the operation of selecting gentle stoppage of the car is provided in a situation where the car cannot be stopped at the nearest floor. Therefore, the components in the hoistway can be restrained from being damaged while the car is not allowed to travel during the occurrence of an earthquake especially in an express zone that requires a long time to stop the car at the nearest floor due to a great floor height. Consequently, the earthquake control operation system for the elevator according to the present invention achieves an effect capable of restoring the elevator promptly after the earthquake.

DETAILED DESCRIPTION OF THE PREFERRED EMBODIMENT

Figure 1:
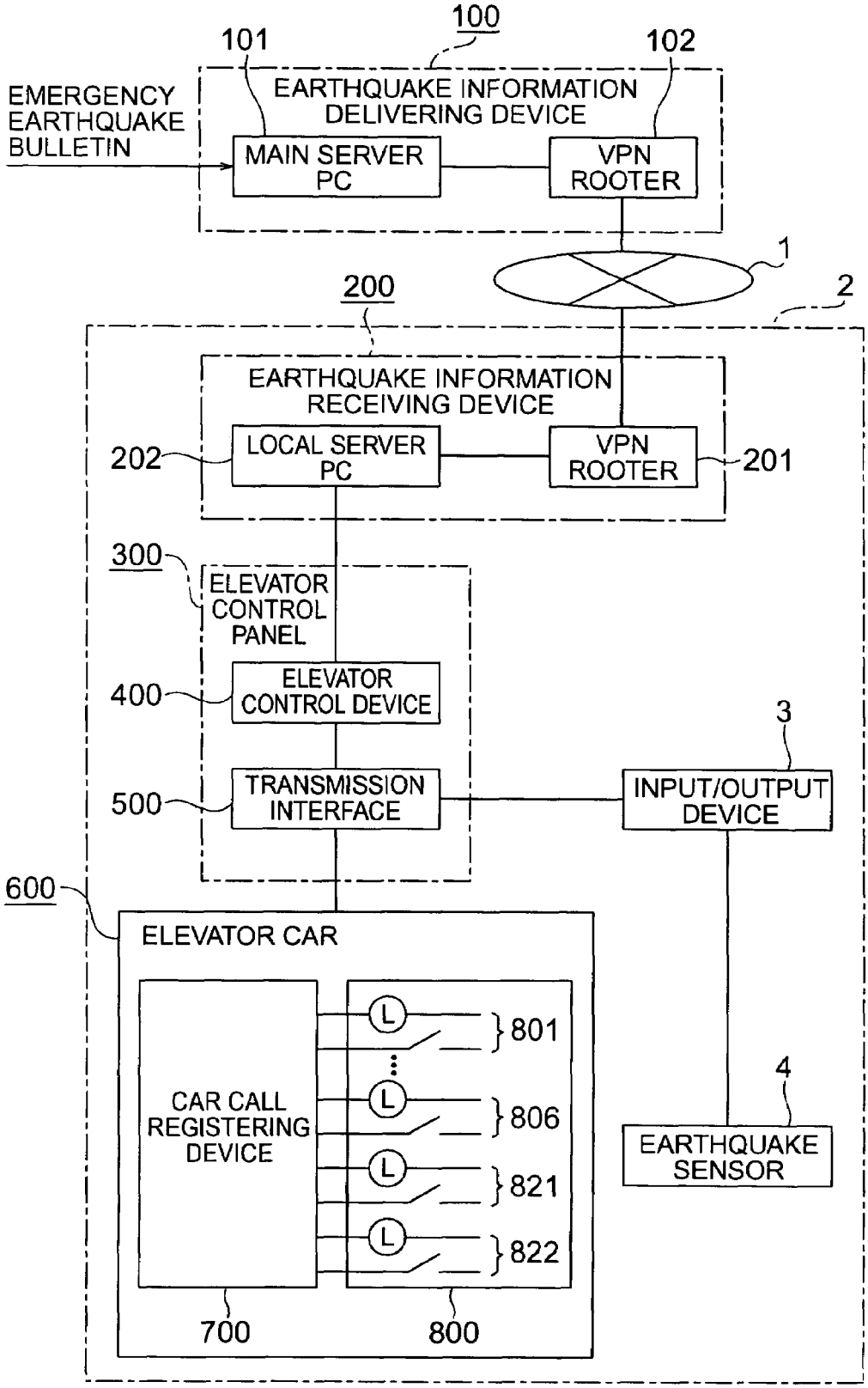
FIG. 1 is a view showing a configuration of an earthquake control operation system for an elevator according to an embodiment of the present invention.

An earthquake control operation system for an elevator according to the embodiment of the present invention will be described with reference to FIGS. 1 to 7. FIG. 1 is a view showing a configuration of the earthquake control operation system for the elevator according to the embodiment of the present invention. In FIGS. 1 to 7, like reference numerals denote like or corresponding parts.

Referring to FIG. 1, an emergency earthquake bulletin includes pieces of information obtained by analyzing a preliminary tremor developed when an earthquake occurs. Those pieces of information includes a seismic center of the earthquake, a depth of the seismic center, an hour of the occurrence of the earthquake, a magnitude of the earthquake, and the like. The emergency earthquake bulletin, which is delivered from the Japan Meteorological Agency or a primary deliverer via an Internet 1, is received by an earthquake information delivering device 100 and then delivered to respective registered buildings. The earthquake information delivering device 100 is composed of a main server PC 101 and a virtual private network (VPN) rooter 102. In accordance with a position of a registered building 2, the main server 101 calculates a predicted arrival hour of earthquake waves, that is, an hour when the earthquake waves arrive at the above position, a predicted maximum acceleration (PMA) of the earthquake waves, and a predicted seismic intensity based on the emergency earthquake bulletin. Those calculated values are delivered to each building by a VPN via the VPN rooter 102 and through the Internet (communication network) 1.

The "predicted arrival hour" is calculated as follows. A distance to an epicenter (surface distance) is calculated using a position of an earthquake source (latitude, longitude, and depth) included in the emergency earthquake bulletin delivered from the Japan Meteorological Agency and a position of a target delivery spot (latitude and longitude). A time required for the earthquake waves to travel from a seismic center of the earthquake to the target delivery spot is then calculated using a maximum speed of the earthquake waves calculated from a calculation formula of Tsukasa and Midorikawa (Collected Treatises on Structural Systems Published by Architectural Institute of Japan, No. 523, 63-70). Furthermore, the hour of the occurrence of the earthquake included in the emergency earthquake bulletin and the calculated time required for the earthquake waves to travel from the earthquake source to the target delivery spot are summated, thereby making it possible to calculate a predicted arrival hour at the target delivery spot.

The "predicted maximum acceleration (PMA)" is calculated from the depth of the earthquake source and the magnitude included in the emergency earthquake bulletin, and the distance to the epicenter calculated through the foregoing calculation, using the calculation formula of Tsukasa and Midorikawa.

The emergency earthquake bulletin delivered from the earthquake information delivering device 100, including the predicted arrival hour, the predicted maximum acceleration (PMA), the predicted seismic intensity, and the like, is received by an earthquake information receiving device 200 installed in each building. The earthquake information receiving device 200 is composed of a VPN rooter 201 and a local server PC 202. The local server PC 202 calculates an earthquake arrival need time (ANT), that is, a time required for the earthquake waves to arrive at the building 2 based on the predicted arrival time received from the earthquake information delivering device 100 via the VPN rooter 201, and delivers to an elevator control panel 300 in the building 2 the emergency earthquake bulletin including the predicted arrival hour, the predicted maximum acceleration (PMA), the predicted seismic intensity, and the like as well as the earthquake arrival need time (ANT).

The "earthquake arrival need time (ANT)" is calculated from a difference between the calculated predicted arrival hour and a current hour of the local server PC 202.

The elevator control panel 300 creates a control signal based on the earthquake arrival need time (ANT) and the predicted maximum acceleration (PMA) received from the earthquake information receiving device 200, and controls the operation of an elevator car 600 (hereinafter referred to simply as the car 600) to perform a control operation. The elevator control panel 300 is composed of an elevator control device 400 and a transmission interface 500. The elevator control device 400 creates a control signal for controlling the car 600 based on the information received from the earthquake information receiving device 200, and sends the control signal to the car 600 via the transmission interface 500. The transmission interface 500 ensures smooth transmission of data between the elevator control device 400 and the car 600 or an input/output device 3.

In the car 600, the operations of call buttons 801 to 806, a door opening button 821, and a door closing button 822 provided on a car operating panel 800 are processed by a car call registering device 700, and information on the buttons 801 to 806, 821, and 822 is transmitted to the elevator control panel 300.

The elevator control panel 300 also receives a signal from an earthquake sensor 4 via the input/output device 3, and performs a control operation by means of the earthquake sensor 4. The earthquake sensor 4 detects a preliminary tremor or a principal motion of an earthquake and sends a signal.

Figure 2:
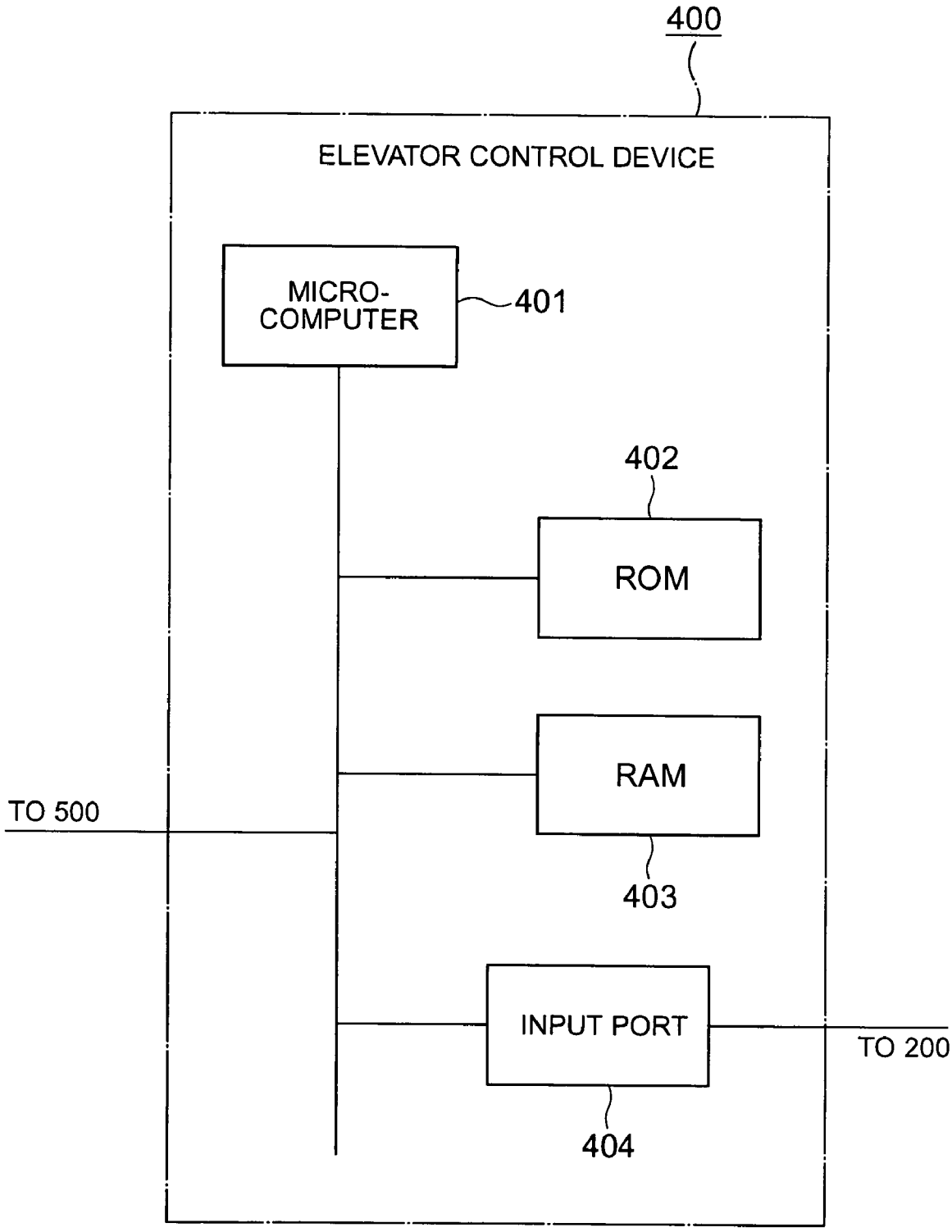
FIG. 2 is a view showing a detailed configuration of an elevator control device shown in FIG. 1.

FIG. 2 is a view showing a detailed configuration of the elevator control device 400 shown in FIG. 1.

Referring to FIG. 2, software codes serving to control the elevator according to the embodiment of the present invention are stored in a ROM 402, and parameters for performing control are stored in a RAM 403. In the elevator control device 400, calculations are performed in a microcomputer 401 to generate control data, and a control signal is transmitted to the car 600 via the transmission interface 500.

The predicted maximum acceleration (PMA) of the earthquake and the earthquake arrival need time (ANT) transmitted from the earthquake information receiving device 200 are inputted to an input port 404, and then stored in a RAM 403. A procedure of performing the control operation is determined based on the predicted maximum acceleration (PMA) and the earthquake arrival need time (ANT).

Figure 3:
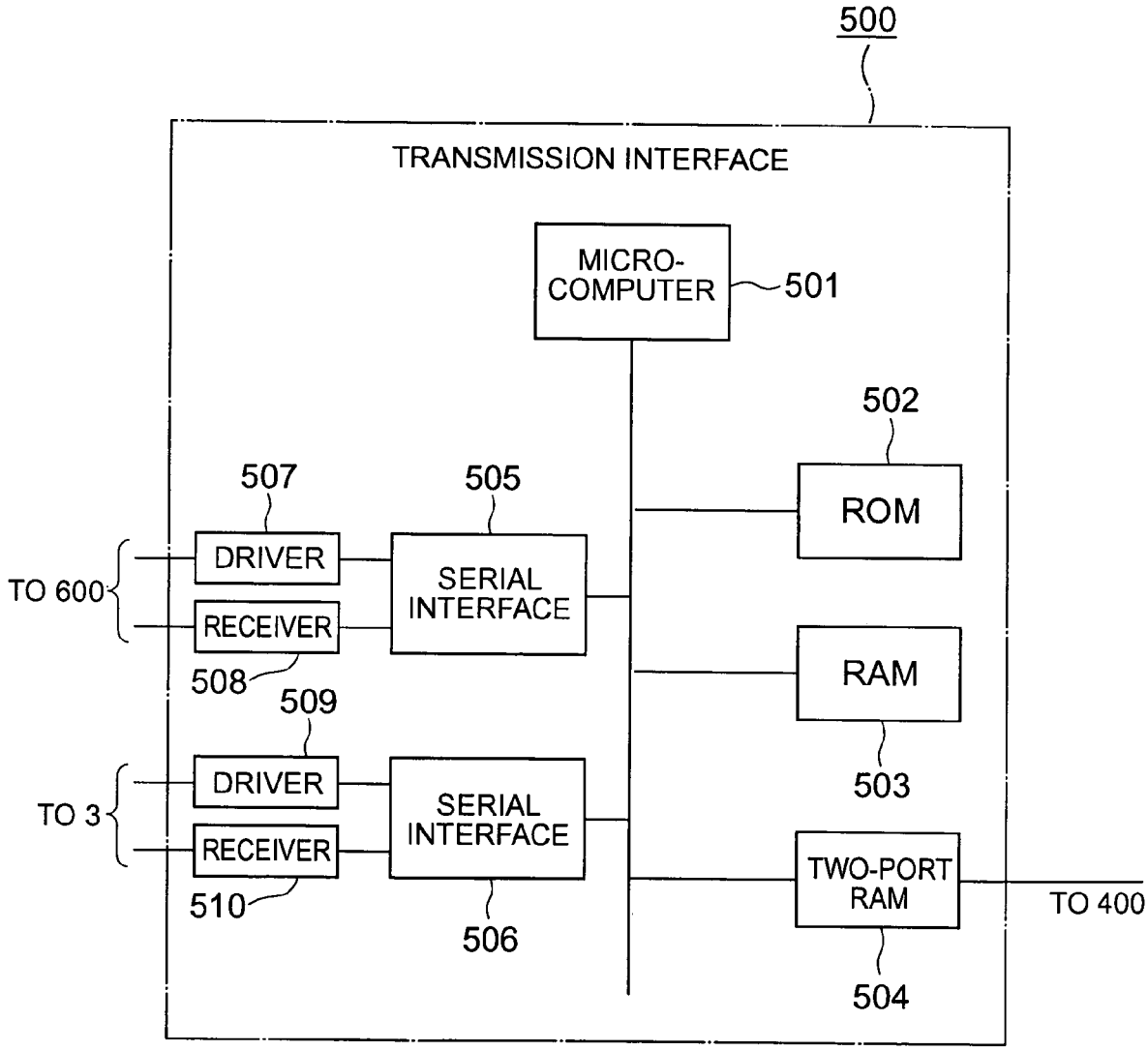
FIG. 3 is a view showing a detailed configuration of a transmission interface shown in FIG. 1.

FIG. 3 is a view showing a detailed configuration of the transmission interface 500 shown in FIG. 1.

Referring to FIG. 3, the transmission interface 500 operates through a microcomputer 501 for control ling data transmission, reads a communication program code from a ROM 502, and retrieves data such as parameters from a RAM 503 to perform a data transmission processing.

Control signals transmitted from the elevator control device 400 of FIG. 1 are temporarily stored in a two-port RAM 504 and then sequentially retrieved. Data are then converted by a serial interface 505 and sent to the car 600 of FIG. 1 by a driver 507. The data sent from the car 600 are received by a receiver 508 and transmitted to the elevator control device 400 via the serial interface 505 and the two-port RAM 504. Data from the earthquake sensor 4 of FIG. 1 are received by a receiver 510 via the input/output device 3 and then transmitted to the elevator control device 400.

Figure 4:
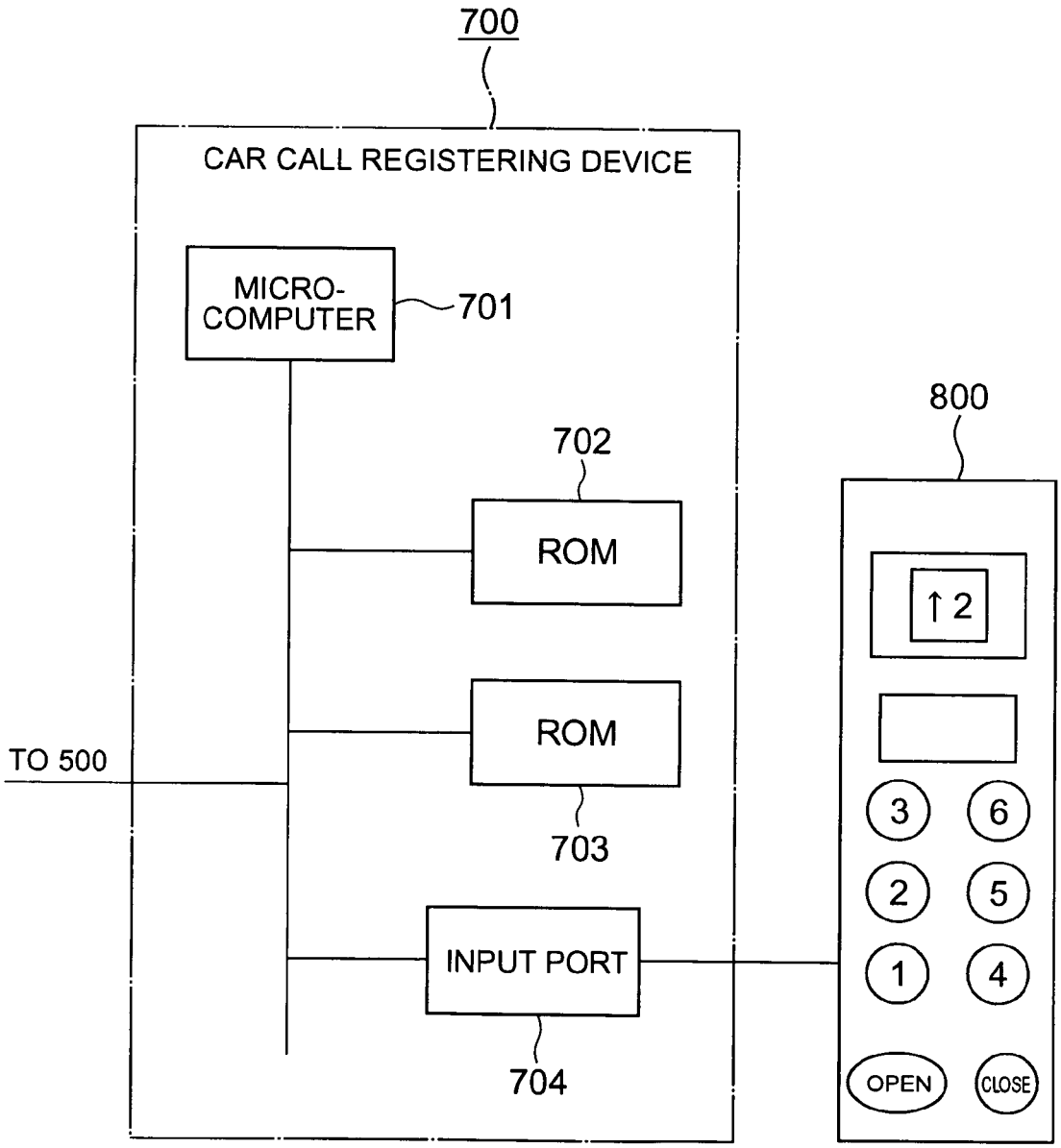
FIG. 4 is a view showing a detailed configuration of a car call registering device shown in FIG. 1.

FIG. 4 is a view showing a detailed configuration of the car call registering device 700 shown in FIG. 1.

The car call registering device 700 operates through a microcomputer 701, reads a program code from a ROM 702, and retrieves data such as parameters from a RAM 703 to perform a data transmission processing. A signal of a car call registering button operated through the car operating panel 800 is sent to the transmission interface 500 via an input port 704.

Figure 5:
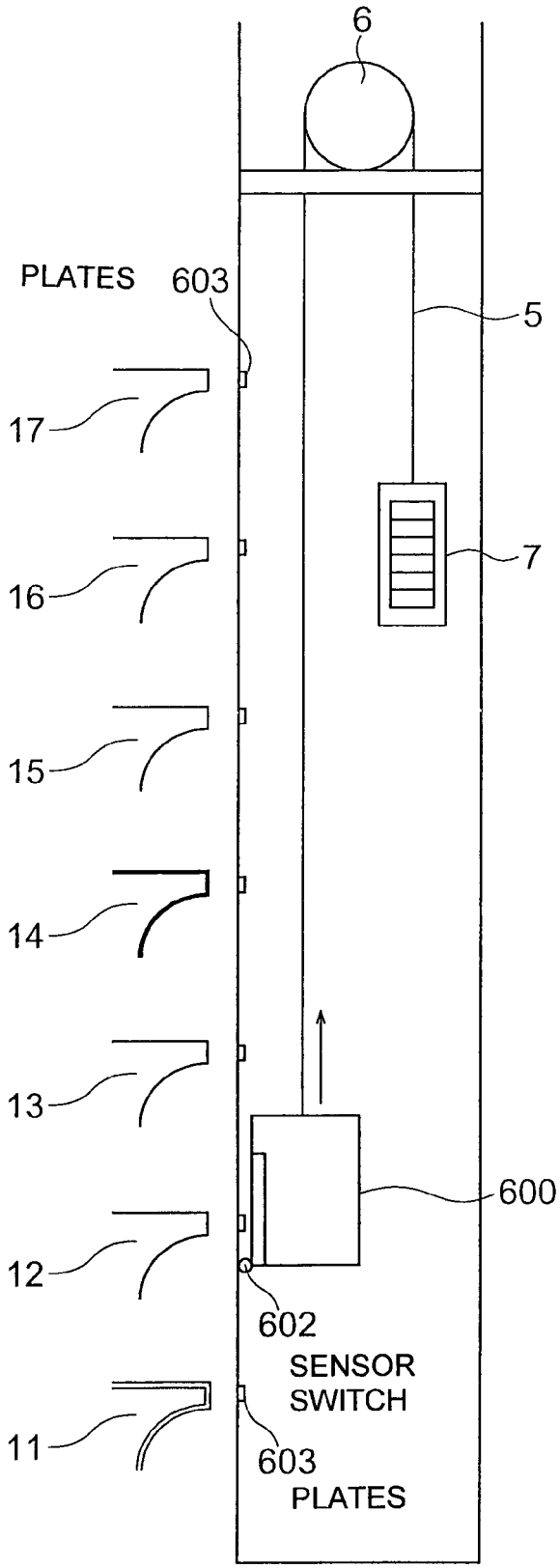
FIG. 5 is a schematic lateral view of interior of a hoistway and landings of the earthquake control operation system for the elevator according to the embodiment of the present invention.

FIG. 5 is a schematic lateral view of a hoistway and landings of the earthquake control operation system for the elevator according to the embodiment of the present invention.

Referring to FIG. 5, the car 600 is suspended by a main rope 5, and raised/lowered through rotation of a hoisting machine 6. The car 600 is balanced with a counterweight 7, so the load applied to the hoisting machine 6 is reduced.

There are provided landings 11 to 17 at first to seventh floors, respectively. For example, the nearest stop floor of the car 600 is the fourth floor when the car 600 is traveling upward past the second floor. In FIG. 5, the landing 14 of the nearest stop floor (fourth floor) is indicated by a bold line. A safety floor of the building 2 is designated as, for example, the first floor. In FIG. 5, the landing 11 of the safety floor (first floor) is indicated by double lines.

Figure 6:
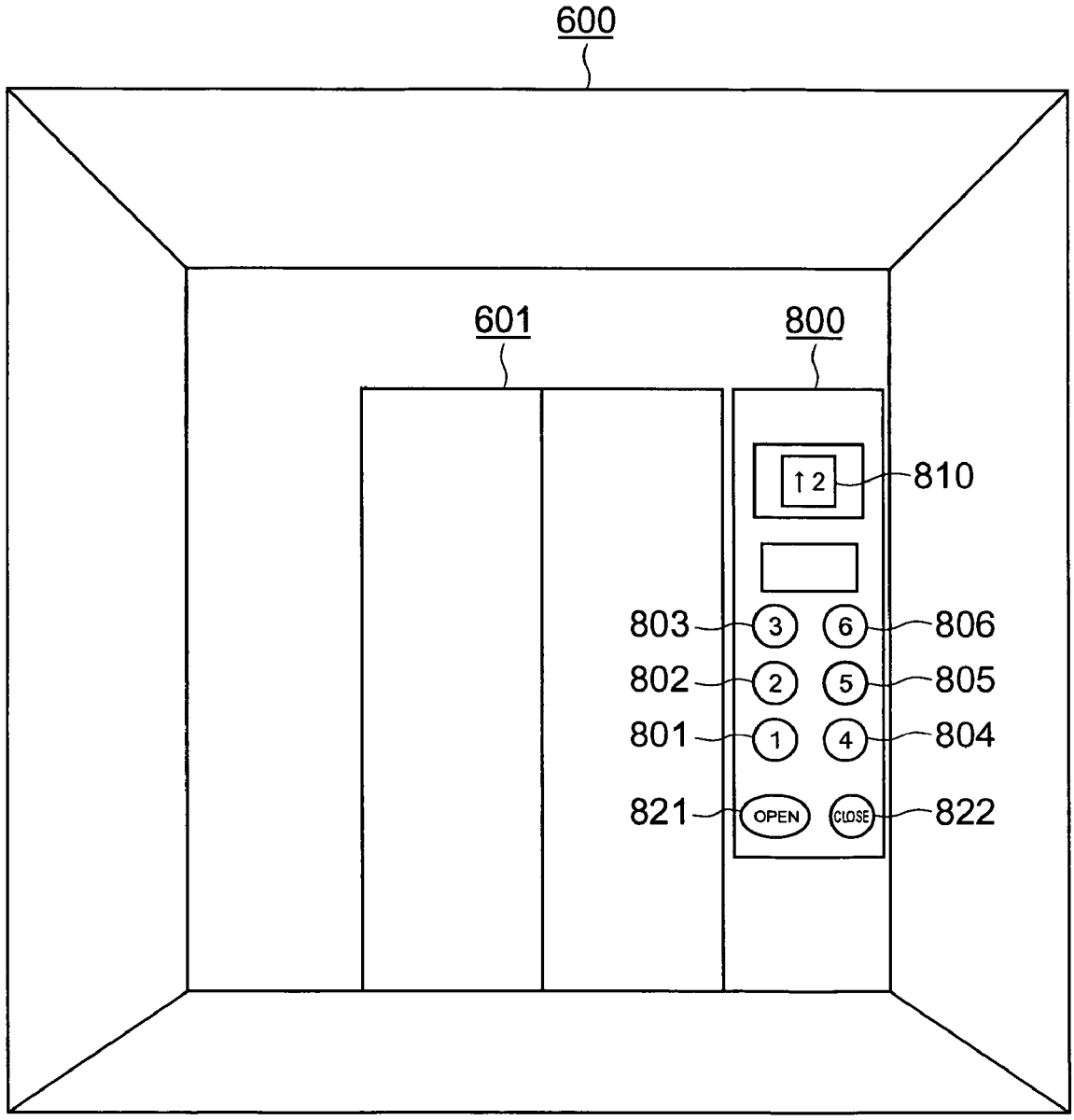
FIG. 6 is a view showing interior of an elevator car of the earthquake control operation system for the elevator according to the embodiment of the present invention.

FIG. 6 is a view showing the interior of the car 600 of the earthquake control operation system for the elevator according to the embodiment of the present invention.

Referring to FIG. 6, an indicator 810 includes a direction lamp (arrow) indicating an upward or downward traveling direction of the car 600, and indicates a current floor of the car 600. For example, in FIG. 6, the indicator 810 indicates that the car 600 is traveling upward while passing the second floor. The call buttons 801 to 806 are designed to register calls made in the car 600, for example, calls for the first to sixth floors in the elevator control device 400. Furthermore, the call button 805 for the fifth floor is represented by a bold circle to indicate that it has been operated. By pressing the door opening button 821, a car door 601 is opened only when the car 600 is stopped. By pressing the door closing button 822, the car door 601 is closed only when it is open. The car call registering buttons 801 to 806, 821, and 822 and the indicator 810 are mounted on the car operating panel 800.

Figure 7:
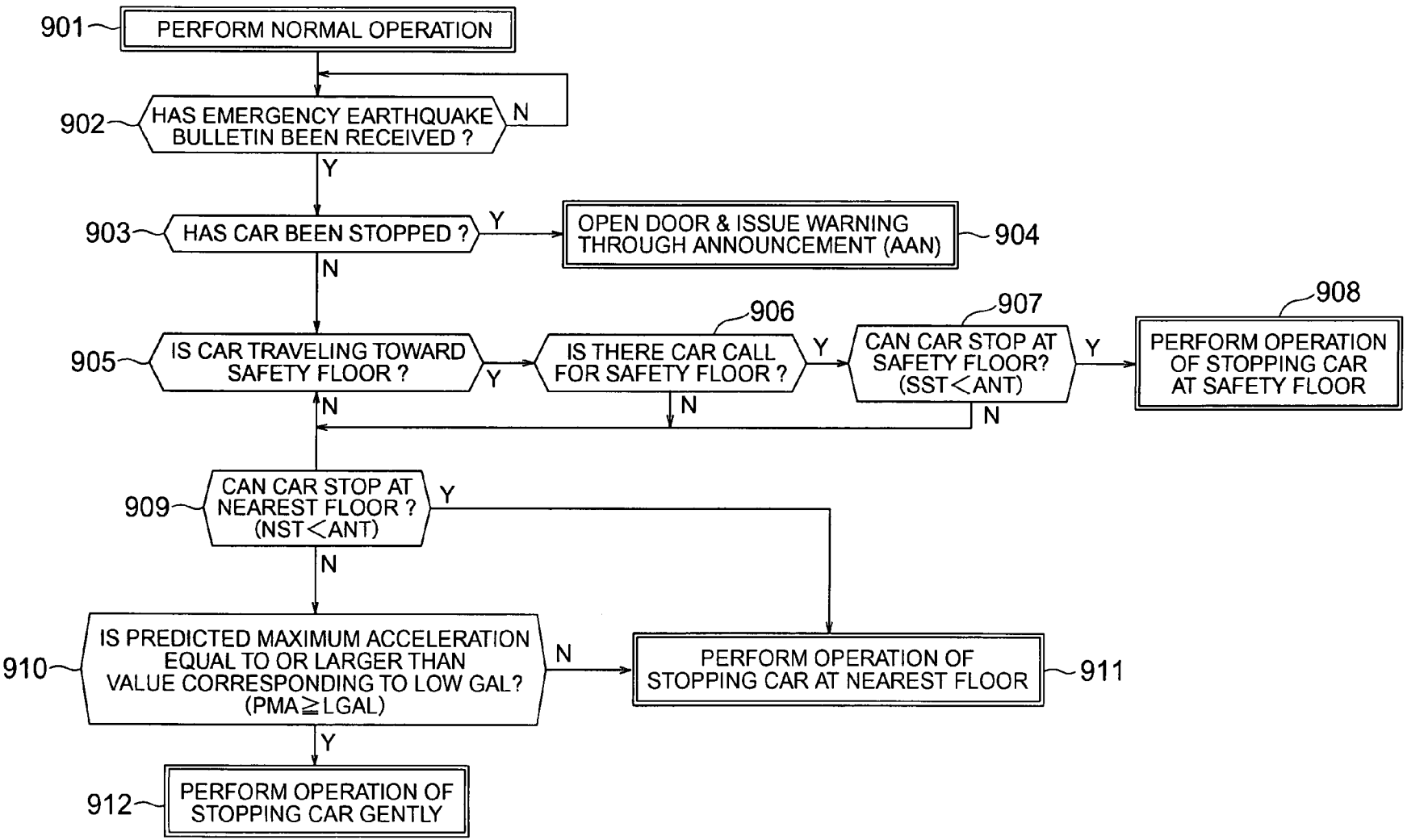
FIG. 7 is a flowchart showing an earthquake control operation selecting procedure of the elevator control device of the earthquake control operation system for the elevator according to the embodiment of the present invention.

Next, the operation of the earthquake control operation system for the elevator according to the embodiment of the present invention will be described with reference to FIGS. 5 to 8. FIG. 7 is a flowchart showing a procedure of selecting a control operation of the elevator control device 400 of the earthquake control operation system for the elevator according to the embodiment of the present invention.

In Steps 901 and 902, the elevator control device 400 performing a normal operation always determines whether or not an emergency earthquake bulletin delivered from the Japan Meteorological Agency or the primary deliverer has been received via the earthquake information delivering device 100 and the earthquake information receiving device 200, and continues to perform the normal operation unless the emergency earthquake bulletin has been received.

Then in Step 903, the elevator control device 400 detects a current state of the car 600 after having received the emergency earthquake bulletin. In Step 904, when it is determined that the car 600 has been stopped, the elevator control device 400 opens the car door 601 at a floor where the car 600 is stopped, and performs an operation of issuing a warning through announcement (AAN). This operation allows passengers to get off the car 600 promptly prior to the arrival of the earthquake. Also, attention of the passengers is acoustically attracted by means of a speaker (not shown) mounted on the car operating panel 800. Whether or not "the car 600 has been stopped" is determined as follows. When a sensor switch 602 installed on the car 600 comes into mechanical contact with one of plates 603 installed on the lading sides of the respective floors in the hoistway, an ON signal indicating that the car 600 exists at a stop position of a corresponding one of the floors is outputted from the sensor switch 602. The elevator control device 400 for managing the operation of the elevator then manages the stopped state of the car 600.

Then in Step 905, when it is determined that the car 600 has not been stopped, the elevator control device 400 determines whether or not the car 600 is traveling toward the safety floor. For example, as shown in FIG. 5, the car 600 is traveling upward past the second floor while the first floor is the safety floor. In other words, the car 600 is traveling away from the safety floor. In this case, the determination in Step 905 results in NO. Whether or not "the car 600 is traveling toward the safety floor" is determined from the floor number of the safety floor 11 set as a current position (floor) of the car 600, which is stored in the RAM 403 of the elevator control device 400, and from the traveling direction (UP/DOWN) of the car 600 managed by the elevator control device 400.

Then in Step 906, when it is determined that the car 600 is traveling toward the safety floor (YES), it is determined whether or not a car call for the safety floor has been registered. For example, in the case of FIG. 6, since only the call button 805 out of the call buttons 801 to 806 has been operated to register a car call for the fifth floor (as indicated by a bold circle), no car call for the safety floor has been registered. In this case, the determination in Step 906 results in NO. ON/OFF signals from the call buttons 801 to 806 are recorded by means of the RAM 403 of the elevator control device 400. When a car call for a floor corresponding to the set safety floor 11 has been registered, the elevator control device 400 recognizes that a car call for the safety floor 11 has been registered.

Then in Steps 907 and 908, when there is a car call for the safety floor (YES), it is determined based on the earthquake arrival need time (ANT) included in the emergency earthquake bullet in whether or not the car 600 can be stopped at the safety floor. More specifically, when a safety floor stop time (SST) is shorter than the earthquake arrival need time (ANT), it is determined that the car 600 can be stopped at the safety floor. When it is determined that the car 600 can be stopped at the safety floor, an operation of stopping the car 600 at the safety floor is performed in Step 908.

Figure 8:
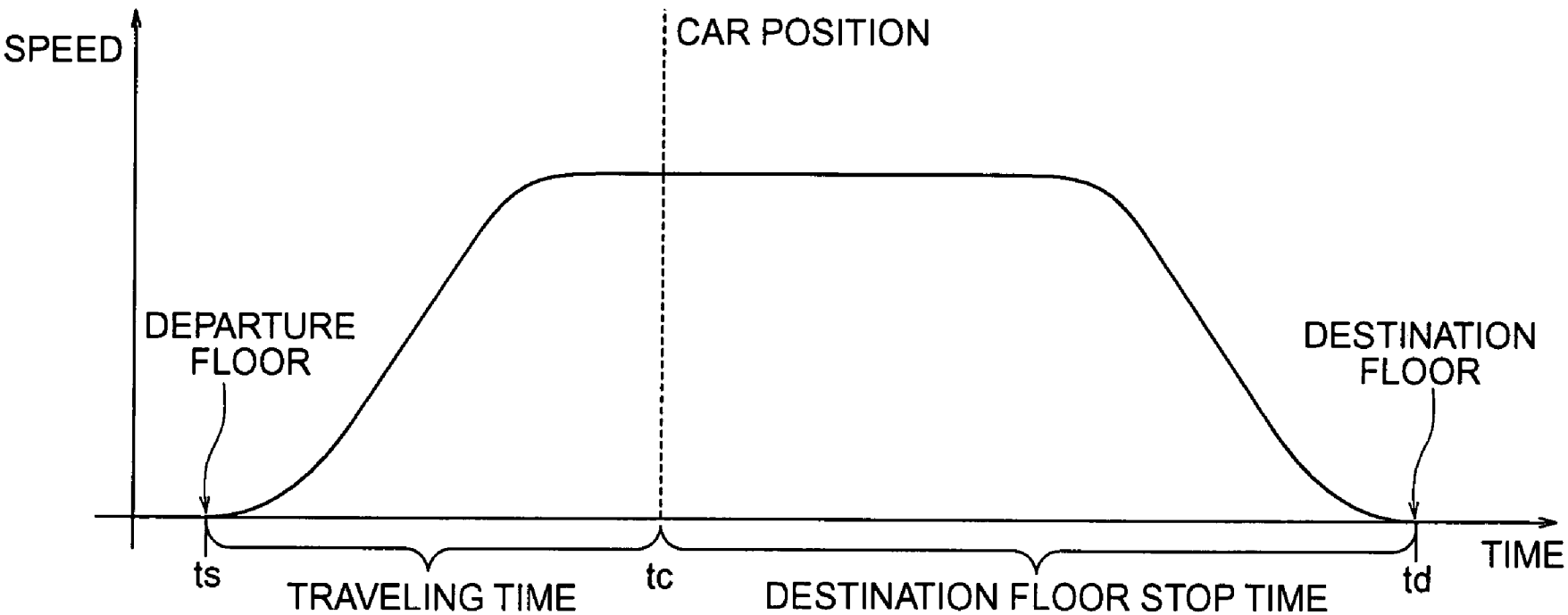
FIG. 8 is a view showing a running speed pattern of the elevator with respect to a running time in the elevator control device of the earthquake control operation system for the elevator according to the embodiment of the present invention.

The "safety floor stop time (SST)" is calculated as follows. The elevator control device 400 creates a traveling speed pattern of the elevator with respect to a traveling time as shown in FIG. 8, from a distance between a departure floor and a destination floor (safety floor) of the elevator, and then calculates a time (td-tc) (the safety floor stop time (SST)) it takes until the elevator reaches the destination floor from a time (td-ts) required for the elevator to travel from the departure floor to the destination floor, which is obtained in terms of the traveling speed pattern, and from a traveling time (tc-ts) since departure of the elevator from the departure floor.

Then in Step 909, when the determination in Step 905 results in NO (i.e., the car 600 is not traveling toward the safety floor) or the result in Step 906 results in NO (i.e., there is no car call for the safety floor) or the determination in Step 907 results in NO (i.e., the car 600 cannot be stopped at the safety floor), it is determined based on the earth quake arrival need time (ANT) included in the emergency earthquake bulletin whether or not the car 600 can be stopped at the nearest floor. When the car 600 can be stopped at the nearest floor, the operation of stopping the car 600 at the nearest floor is performed in Step 911. More specifically, when a nearest floor stop time (NST) is shorter than the earthquake arrival need time (ANT), the car 600 can be stopped at the nearest floor.

The "nearest floor stop time (NST)" can be calculated in the same manner as the safety floor stop time (SST), by replacing the safety floor (destination floor) with the nearest floor.

Then in Steps 910 and 911, when the car 600 cannot be stopped at the nearest floor, it is determined whether or not the predicted maximum acceleration (PMA) included in the emergency earthquake bulletin allows the car 600 to travel during the occurrence of a seismic ground motion. More specifically, when the predicted maximum acceleration (PMA) is smaller than a value corresponding to a low gal (LGAL) of the earthquake sensor 4, the operation of stopping the car 600 at the nearest floor is performed because it is determined that the elevator will suffer no serious damage.

The "value corresponding to the low gal" is equal to a set value of the earthquake sensor 4 prescribed by Building Standard Law. More specifically, the "value corresponding to the low gal" is equal to a set gal value of the earthquake sensor 4 which is set according to the height of the building. That is, the set gal value is 120 gal when the building is lower than 60 m, 60, 80, or 100 gal when the building is equal to or higher than 60 m and lower than 120 m, and 40, 60, or 80 gal when the building is equal to or higher than 120 m.

In Step 912, when the predicted maximum acceleration (PMA) is equal to or larger than the value corresponding to the low gal (LGAL) of the earthquake sensor 4, the components in the hoistway or the car 600 may suffer a serious damage if the elevator continues to be operated. Therefore, an operation of stopping the car 600 gently is performed even when the car 600 is located between two adjacent floors.

In this manner, an effect of reducing damages caused to the components in the hoistway, components in the car 600, a rail, and the like can be achieved by allowing passengers to get off the car 600 and stopping the car 600 preferably prior to the arrival of earthquake waves, with the aid of the emergency earthquake bulletin.

Although the determinations on the operation of stopping the car 600 at the nearest floor and the operation of stopping the car 600 gently are made depending on the magnitude of the predicted maximum acceleration (PMA) in Step 910 of the embodiment of the present invention, it is possible to dispense with Step 910. In this case, an effect of more drastically reducing the damage caused to the components is achieved.

In Step 910, the predicted maximum acceleration (PMA) included in the emergency earthquake bulletin, which is used as a criterion for making a determination, may be a predicted seismic intensity. In this case as well, the same effect as described as above is substantially achieved.

When the determination in Step 905 or 906 results in NO, operations of making a determination on the earthquake arrival need time (ANT) again and moving the car 600 to such a position that the damage caused to the components can be more drastically reduced may be added after the operation of stopping the car 600 at the nearest floor in Step 911 has been completed and an unmanned state of the car 600 has been confirmed.

In addition, when the predicted maximum acceleration (PMA) and the earthquake arrival need time (ANT) have been reset and the operation of the earthquake sensor 4 has been canceled after the completion of the operation of stopping the car 600 gently in Step 912, a damage caused to the components in the hoistway is automatically detected. A transition to an operation of moving the car 600 to the nearest floor through low-speed automatic operation may be made if no abnormality is detected.

What is claimed is:

1. An earthquake control operation system for an elevator, comprising:

an earthquake information delivering device for calculating a predicted arrival hour of earthquake waves as an hour when the earthquake waves arrive at a position of a registered building in accordance with the position of the registered building based on an emergency earthquake bulletin including at least a seismic center of an earthquake, a depth of the seismic center, and an hour of occurrence of the earthquake;

an earthquake information receiving device installed in the building, for receiving the predicted arrival hour through a communication network and calculating an earthquake arrival need time as a time required for the earthquake waves to reach the building based on the predicted arrival hour; and an elevator control panel for performing an operation of stopping an elevator car at a safety floor when the elevator car is traveling toward the safety floor, a car call for the safety floor is registered, and a stop time at the safety floor is shorter than the earthquake arrival need time.

2. An earthquake control operation system for an elevator according to claim 1, wherein the elevator control panel performs an operation of stopping the elevator car at a nearest floor if a nearest floor stop time is shorter than the earthquake arrival need time when the car travels away from the safety floor, no car call for the safety floor has been registered, and the safety floor stop time is equal to or longer than the earthquake arrival need time.

3. An earthquake control operation system for an elevator according to claim 2, wherein:

the earthquake information delivering device calculates a predicted maximum acceleration of the earthquake waves based on the emergency earthquake bulletin; and the elevator control panel receives the predicted maximum acceleration through the earthquake information receiving device, and performs the operation of stopping the elevator car at the nearest floor if the predicted maximum acceleration is smaller than a value corresponding to a low gal of an earthquake sensor installed in the building when the nearest floor stop time is equal to or longer than the earthquake arrival need time.

4. An earthquake control operation system for an elevator according to claim 3, wherein the elevator control panel performs an operation of stopping the elevator car gently if the predicted maximum acceleration is equal to or larger than the value corresponding to the low gal of the earthquake sensor installed in the building.

5. An elevator system comprising:

an earthquake occurrence predicted hour calculating means for calculating a predicted hour when an earthquake wave arrives at a position of an elevator based on earthquake information delivered from a third party and position information registered beforehand where the elevator is installed; and an elevator control panel for controlling operation of an elevator car to stop at a safety floor when the elevator car is traveling toward the safety floor, a car call for the safety floor is registered. and a predicted time to stop the car at the safety floor is earlier than the predicted hour when the earthquake wave arrives at the position of the elevator.

6. An elevator system comprising:

an earthquake occurrence predicted hour calculating section configured to calculate a predicted hour when an earthquake wave arrives at a position of an elevator based on earthquake information delivered from a third party and position information registered beforehand where the elevator is installed; and an elevator control panel configured to control operation of an elevator car to stop at a safety floor when the elevator car is traveling toward the safety floor, a car call for the safety floor is registered, and a predicted time to stop the car at the safety floor is earlier than the predicted hour when the earthquake wave arrives at the position of the elevator.

* * * * *